United States Patent [19]

Oono et al.

[11] Patent Number: 4,844,737

[45] Date of Patent: Jul. 4, 1989

[54] METHOD FOR OPERATING A BLAST FURNANCE BY BLOWING PULVERIZED COAL

[75] Inventors: Yotaro Oono; Hiroshi Saito; Takehiko Miyamoto; Kazumasa Wakimoto; Hitoshi Kawada; Masahiro Matsuura, all of Tokyo, Japan

[73] Assignee: Nippon Kokan Kabushiki Kaisha, Tokyo, Japan

[21] Appl. No.: 134,803

[22] Filed: Dec. 18, 1987

[30] Foreign Application Priority Data

Dec. 27, 1986 [JP] Japan ..... 61-309140
Dec. 27, 1986 [JP] Japan ..... 61-309141
Jan. 6, 1987 [JP] Japan ..... 62-221

[51] Int. Cl.[4] ..... C21B 5/00
[52] U.S. Cl. ..... 75/42
[58] Field of Search ..... 75/42

[56] References Cited

U.S. PATENT DOCUMENTS 2,593,257 4/1952 Bradley et al. .
3,460,934 8/1969 Kelmar ..... 75/41
3,814,404 6/1974 Claflin ..... 75/42
4,198,228 4/1980 Jordan .

FOREIGN PATENT DOCUMENTS 980962 5/1951 France .
1492838 8/1967 France .
4939 6/1956 Japan .
3356 6/1957 Japan .
32323 8/1977 Japan .
159104 8/1985 Japan .

OTHER PUBLICATIONS

Steel in the USSR, vol. 16, No. 10, Oct. 1986, pp. 506–508, London, GB; A. I. Strelets et al: "Assessing Effectiveness of Using Pulverized Coal in Blast Furnaces With Aid of ES Computer".

Steel in the USSR, vol. 11, No. 1, Jan. 1981, pp. 1–5, London, GB; A. N. Ramm: "Use of Combined Blast in Blast Furnance Operation".

*Primary Examiner*—Melvyn J. Andrews
*Attorney, Agent, or Firm*—Frishauf, Holtz, Goodman & Woodward

[57] ABSTRACT

A method for operating a blast furnace, comprising the steps: charging iron ores and cokes through a furnace top into the blast furnace; blowing in gas containing 40 vol. % or more oxygen together with pulverized coal through tuyeres into the blast furnance; and controlling a fuel ratio within a range of 500 to 930 kg/ton., molten pig iron and still a ratio of the pulverized coal blown in through the tuyeres within a range satisfying the formula:

$$100 \text{ to} \left\{ \frac{530 - 300}{930 - 500} (X - 500) + 300 \right\} \text{kg/ton.},$$

molten pig iron, where X represents a fuel ratio. Through blown-in inlets set in the furnace shaft, preheating gas is blown in to preheat burdens. The cokes charged into the blast furnace are cokes of low strength having a drum index of $DI_{15}^{30}$ of 80 to 90% .

8 Claims, 3 Drawing Sheets

METHOD FOR OPERATING A BLAST FURNANCE BY BLOWING PULVERIZED COAL

BACKGROUND OF THE INVENTION

1. Field of the Invention

The present invention relates to a method for operating a blast furnace, and more particularly to a method for operating the blast furnace wherein pulverized coal is blown in through tuyeres of the blast furnace.

2. Description of the Prior Arts

It has been customarily practiced that pulverized coal is blown in together with hot blast air through tuyeres of a blast furnace to be substituted partially for cokes introduced through a furnace top into the blast furnace. This substitution amount for the cokes, however, is 50 to 60kg per molten pig iron ton on the ground that the following is taken care of:

(a) Flame temperature at a nose of the tuyere goes down because endothermic reaction of volatile matters contained in the pulverized coal occurs due to decomposition of the volatile matters in advance of combustion of the pulverized coal; and (b) the pulverized coal is put into perfect combustion at the vicinity of the nose of the tuyere.

Furthermore, in order to improve blast furnace productivity, recently, various reports of allowing blast gas blown in through the tuyeres to be composed mainly of oxygen have been made. For example, a Japanese Patent Application Laid Open (KOKAI) No. 159104/85 discloses a method wherein:

(1) Through a furnace top, burdens composed mainly of iron ores and cokes are charged into a blast furnace;

(2) Through tuyeres, pure oxygen, pulverized coke and temperature control gas which restrains flame temperature at the tuyere nose from rising are blown in;

(3) Through an intermediate level of the blast furnace, preheating gas which is free substantially from nitrogen is blown in to preheat the burdens; and (4) By means of the pure oxygen blown in, the cokes included in the burdens are burned to melt and reduce the iron ores charged as well as to generate a blast furnace gas which substantially free from nitrogen from the furnace top.

This method, however, has been very hard to last a stable operation of the blast furnace through a long period.

SUMMARY OF THE INVENTION

An object of the present invention is to provide a method for allowing a blast furnace to operate stably through a long period.

In accordance with the present invention, a method is provided for operating a blast furnace which comprises the steps of:

charging iron ores and cokes through a furnace top into the blast furnace;

blowing in gas containing 40vol.% or more oxygen together with pulverized coal through tuyeres into the blast furnace; and controlling a fuel ratio within a range of 500 to 930kg/ton., molten pig iron and still a ratio of the pulverized coal blown in through the tuyeres within a range satisfying the formula:

$$100 \text{ to} \left\{ \frac{530 - 300}{930 - 500} (X - 500) + 300 \right\} \text{kg/ton.,}$$

molten pig iron, where X represents the fuel ratio. The low strength coke which is used is discussed hereinafter.

The objects and other objects and advantages of the present invention will become more apparent from the detailed description to follow, taken in conjunction with the appended drawings.

DESCRIPTION OF THE PREFERRED EMBODIMENT

Figure 1:
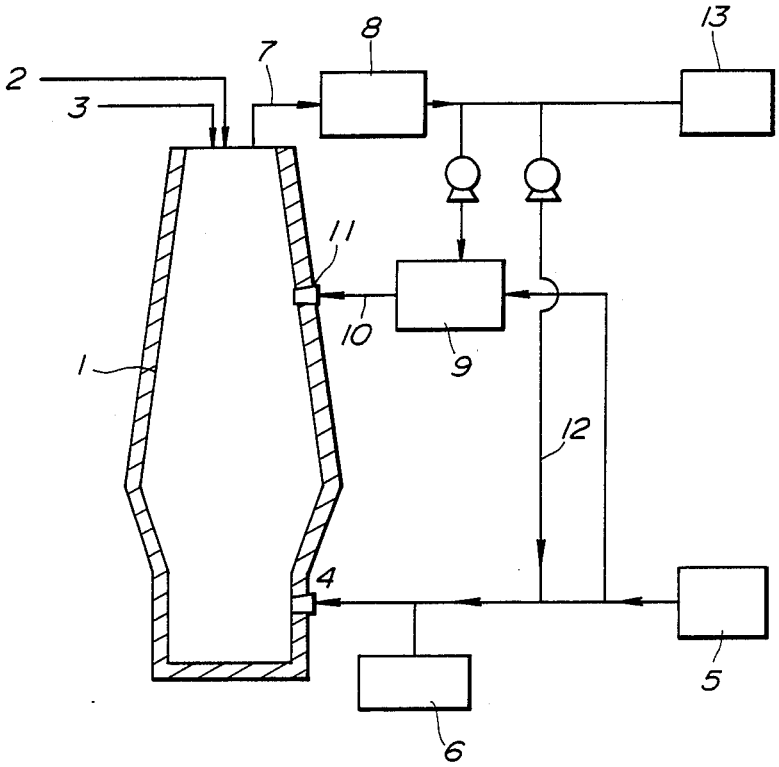
FIG. 1 is a schematic view showing an example of a method of operating a blast furnace according to the present invention.

Now, with the specific reference to FIG. 1 of the drawing, a preferred embodiment of a method for operating a blast furnace according to the present invention will be described.

FIG. 1 schematically illustrates an example of a method for operating a blast furnace according to the present invention. Iron ores 2 and cokes 3 are charged through a furnace top into blast furnace 1. Through tuyeres 4, pure oxygen 5, pulverized coal 6, and furnace top gas 12 as flame temperature control gas are blown in. Through blown-in inlets 11 of an intermediate level of the blast furnace, preheating gas 10 generated in generating equipment 9 for preheating gas is introduced into the blast furnace to preheat those which have been charged into the blast furnace. In this process, not only a fuel ratio summing up a coke ratio and a pulverized coal ratio is set to be within a range of 500 to 930 kg/ton., molten pig iron but also the pulverized coal ratio to be within a ratio satisfying the formula given by the following:

$$100 \text{ to} \left\{ \frac{530 - 300}{930 - 500} (X - 500) + 300 \right\} \text{kg/ton.,}$$

molten pig iron, where X represents a fuel ratio.

According to the aforementioned process, cokes 3 and pulverized coal 6 are allowed to perfectly be combusted with pure oxygen 5 blown in through the tuyeres, and then, by means of reduction gas of high temperature thus generated, iron ores 2 are melted and reduced to molten pig iron and slag. Furnace top gas 7, which is substantially free from nitrogen, is generated through the furnace top. The furnace top gas is sent, through gas cleaning equipment 8, to gas holder 13, but some of the furnace top gas is allowed, on the way from the cleaning equipment to the gas holder, to branch in generating device 9 or in tuyeres 4 for being blown in as temperature control gas 12 into the blast furnace.

Blow-in of Pulverized coal

To efficiently substitute pulverized coal 6, which is blown in through tuyeres 4, for cokes 3, which are charged through the furnace top, the following have been found important:

(a) The pulverized coal blown in through the tuyeres gets volatile before the pulverized coal has combusted perfectly, and due to the endothermic reaction at the time of the volatile matters in the pulverized coal being decomposed, flame temperature at a nose of the tuyeres often drops. Therefore, it is preferable to avoid blow-in of pulverized coal in such an amount as to lower the flame temperature at the tuyere nose to less than 2000° C.;

(b) It is necessary that the pulverized coal be combusted perfectly immediately after the pulverized coal is blown in, and, so blown-in of the pulverized coal in such an amount exceeding its combustion speed must be avoided; and (c) To allow gas flow in a blast furnace to be optimized, cokes must be allowed to exist in optimum amount in blast furnace burdens so as to procure room necessary for the gas flow.

Based on this knowledge, a substitution amount of the pulverized coal for the cokes is given by the formula:

$$100 \text{ to} \left\{ \frac{530 - 300}{930 - 500} (X - 500) + 300 \right\} \text{kg/ton.,}$$

molten pig iron,.where X represents a fuel ratio.

The relation of the fuel ratio to the substitution amount is so linear that the substitution amount increases in proportion to the increase of the fuel ratio. The reason for the lower limit of the substitution amount being 100 is that the effect of the present invention cannot be obtained if the lower limit is too small. Furthermore, if the substitution amount is over the upper limit, the combustion of the pulverized coal gets imperfect, and the blast furnace operation is deteriorated. The fuel ratio ranges preferably 500 to 930kg/ton., molten pig iron. If the fuel ratio is less than 500kg/ton., molten pig iron, the operation fails to be stable, while if it becomes over 930kg/ton., molten-pig iron, then, the temperature of the furnace top gas exceeds such a temperature of 400° C. as to fail in protecting the furnace top equipment.

Figure 2:
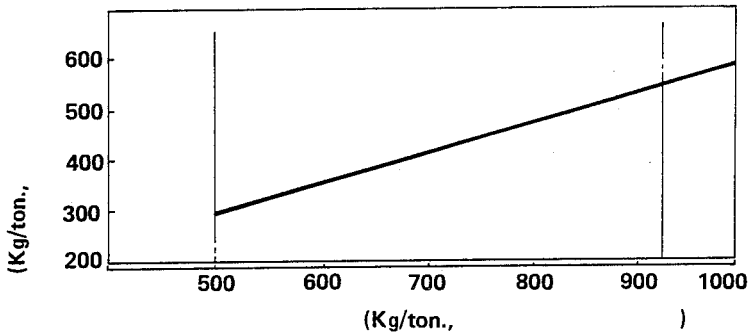
FIG. 2 is a graphic representation showing relation of a fuel ratio (kg/ton., molten pig iron) to a maximum substitution amount of pulverized coal for cokes according to the present invention.

FIG. 2 graphically shows relation of a fuel ratio (kg/ton., molten pig iron) to a maximum substitution amount of the pulverized coal. For example, in a case of the fuel ratio being 500kg/ton., molten pig iron, blow-in of 300kg/ton., molten pig iron is allowable. The graph also shows that in the case of the fuel ratio being 800kg/ton., molten pig iron, pulverized coal of 460kg/ton., molten pig iron substituted for cokes are blown in and cokes of 340kg/ton., molten pig iron is enough to be fed through the furnace top.

Figure 3:
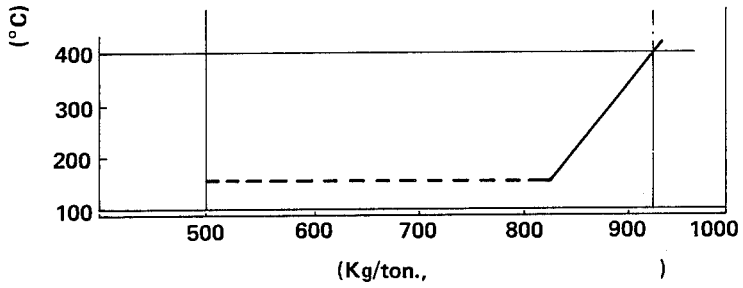
FIG. 3 is a graphic representation showing relation of a fuel ratio (kg/ton., molten pig iron) to furnace top gas temperature according to the present invention.

FIG. 3 graphically shows relation of a fuel ratio (kg/ton., molten pig iron) to a furnace top gas temperature. In the case that the fuel ratio ranges 500 to 830kg/ton., molten pig iron, the furnace top gas temperature is set to 150° C., which is shown by dotted line. This is because preheating gas is introduced into through blow-in inlets set in an intermediate level of the blast furnace to keep the furnace top gas at 150° C. If the fuel ratio is more than 830kg/ton., molten pig iron, the blow-in of the preheating gas is needless, and the furnace top gas temperature is 150° C. or higher. But, if the fuel ratio is over 930kg/ton., molten pig iron, the furnace top gas temperature gets over 400° C. and this is undesirable in view of protecting the furnace top equipment.

Figure 4:
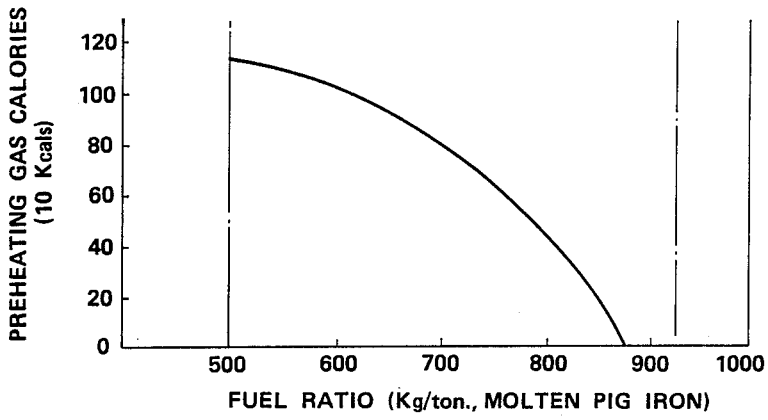
FIG. 4 is a graphic representation showing a preheating gas amount necessary to keep furnace top gas at 150° C. according to the present invention.

FIG. 4 graphically shows preheating gas calories necessary to keep the furnace top gas at a temperature of 150° C. The lower the fuel ratio becomes, the more the calories are required to be supplemented.

Cokes

As cokes to be charged through a furnace top, cokes whose drum index of $DI^{30}{}_{15}$ ranges 80.0 to 90.0% are preferably used. If $DI^{30}{}_{15}$ is less than 80.0%, cokes are easy to be powdered so much that dust is increased and instable furnace conditions occur are undesirably brought about. Even if $DI^{30}{}_{15}$ is over 90.0%, there occurs no inconvenience to operation of the blast furnace, but wasteful work, for example, selecting coking coal more strictly and briquetting coal during coking process is additionally required.

In the conventional blast furnace operation, physical property of cokes have been customarily regulated so as to satisfy the following:

(1) Cokes fed into a blast furnace may not be powdered by means of dead weight which has been formed by layers of burdens introduced, and may not be discharged out of the blast furnace together with gases.

(2) In the blast furnace, reduction starts from the temperature about 700° C., and due to carbon solution loss reaction being activated at the lower furnace portion, the texture of the cokes gets brittle, which reaction must be suppressed as much as possible.

Now, the reason why even such cokes as having a low drum index, $DI^{30}{}_{15}$ of 80 to 90% can be used will be described in detail, in comparison of ordinary blast furnace operation using mainly hot blast air with the operation of the present invention. In the ordinary blast furnace operation, nitrogen content of prevailing gases from a tuyere level to a stock line ranges almost constantly to 57 to 60vol.%. At the shaft level wherein temperature of solid burdens shows 1300° C., in-furnace gases, iron ores and cokes feature as follows:

(a-1) in-furnace gases: $N_2$; approximately 64vol. %, CO; approximately 35vol. % and the rest; a small amount of $H_2$, (b-1) iron ores: metalization degree; approximately 56% and (c01) cokes: 5 to 7% of those reacts.

In the operation of the present invention, nitrogen content of prevailing gases from the tuyere level to the stock line level is only of 2 to 3vol. %. At the shaft level showing 1300° C. of the solid burdens, in-furnace gases, iron ores and cokes feature as follows:

(a-2) in-furnace gases: $N_2$; approximately 2vol.%; CO; approximately 80vol.% and $H_2$; 1.8vol.%, (b-2) iron ores: metalization degree; approximately 85% and (c-2) cokes: approximately 3% of cokes reacts.

In addition, with respect to coke amount which combusts after it goes down upto the tuyere noses, the coke amount of the present invention does reach 91%, while that of the ordinary blast furnace operation is in the vicinity of 79%.

Clearly recognized from these results, according to the operation of the present invention, the potential of gas reduction is remarkably improved, and on the aspect of reaction, indirect reduction ratio is improved and solution loss reaction is reduced. In view from furnace body structure design, the furnace shaft portion can be shortened, and can be as low as almost 2 thirds of that of the ordinary blast furnace. The two terms regulation physical property in the ordinary blast furnace operation can be set off by reduction of the solution loss reaction, shortening time required for the solution loss reaction and lightening burdens' weight due to shortening of the shaft length. In other words, the drum index $DI^{30}_{15}$ of 92% or more customarily required for the conventional blast operation can be alternated by the drum index, $DI^{30}_{15}$ of 80.0 to 90.0% for the operation of the present invention. In order to allow drum index of $D^{30}_{15}$ to range 80.0 to 90.0%, it is satisfactory for mean value of reflectance of coking coal to be 0.800 to 0.950.

The drum index of DI 30/15 employed in this test is provided for in Japanese Industrial Standard and is measured by the terms shown in Table 1.

TABLE 1

| | |
|---|---|
| Drum Inside Diameter | 1500 mm |
| Drum Body Length | 1500 mm |
| Sample Particle Size | >50 mm |
| Sample Amount | 10 kg |
| Drum Revolution Speed | 15 rpm |
| Drum Revolution Time | 2 min |
| Drum Total Revolution | 30 |
| Screen Opening | 15 mm |

Oxygen

Through furnace tuyeres 4, gas of 40vol. % or more oxygen is blown in into a blast furnace. If the oxygen content is 40vol. % or more, pulverized coal of 100kg/ton., molten pig iron or more can be blown in through the tuyeres. Resultantly, this reduces coke consumption, and, thus, the production cost is rationalized. On the other hand, when the oxygen content rises, the flame temperature is elevated, and the temperature at the shaft portion goes down. To prevent the temperature at the shaft portion from going down, preheating gas is introduced through a blow-in inlet set in the shaft portion. The preheating gas is blown in so as to allow the furnace top gas temperature to be 150° C. or higher. The preheating gas is heated upto 700° to 1300° C. The blown-in gas through the tuyeres can contain either gas at the normal temperature, or heated gas. Gas heated to 130°-700° C. The gas can alternatively be pure oxygen heated upto 130° to 700° C.

Figure 5:
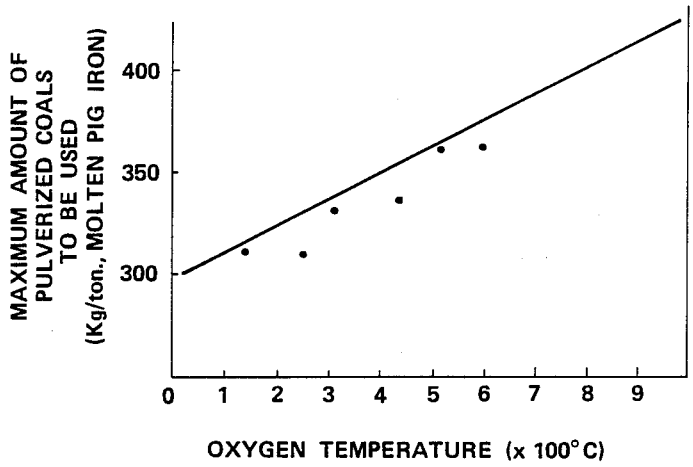
FIG. 5 is a graphic representation showing relation of oxygen temperature to a maximum blow-in amount of pulverized coal to be substituted for cokes according to the present invention.

FIG. 5 graphically shows relation of oxygen temperature to maximum substitution amount of pulverized coal for cokes which is allowed to be blown in into a blast furnace. The graph shows the relation on the condition that the fuel ratio is 550kg/ton., molten pig iron, and the flame temperature at the tuyere nose is set to 2,600° C. From the graph, it becomes apparent that the higher the oxygen temperature is, the more the blown-in amount of the pulverized coal can be increased. The oxygen temperature can be raised upto considerable high temperature, but the operation temperature incorporated with safety allowance ranges 130°-700° C. The graph shows that in this range, considerably satisfactory effect can be attained. It is preferable to make use of wast heat as heat source.

Example 1

Tests No. 1 and No.2 were carried out according to a method of the present invention.

In Test No. 1 operation, not only low fuel ratio but also possible restraint of furnace top gas generation was pursued. Through a furnace top iron ores of 1600 kg/ton., molten pig iron and cokes of 250 kg/ton., molten pig iron were charged, and through tuyeres of a blast furnace, oxygen of 330 $Nm^3$/ton., molten pig iron, pulverized coal of 300 kg/ton., molten pig iron and top furnace gas of 90 $Nm^3$/ton, molten pig iron for controlling flame temperature at the nosess of the tuyere were blown in. The fuel ratio was 550 kg/ton., molten pig iron was a sum of 250 kg/ton., molten pig iron coke ratio and 300 kg/ton., molten pig iron pulverized coal ratio. The flame temperature at the noses of the tuyeres was 2600° C. Through a blown-in inlet at an intermediate shaft level preheating gas of 1000° C. and 290 $Nm^3$/ton., molten pig iron was introduced. Furnace top gas of 18450Kcal/ton., molten pig iron and of 1059 $Nm^3$/ton., molten iron was generated from the furnace top. The cokes used in this Test No. 1 operation was of drum index, $DI^{30}_{15}$ of 92.6%. The pulverized coal blown in through the tuyeres was of 0.2 mm particle size at the maximum, and composed of 70 to 80% of 200 mesh or less pulverized coal. The chemical composition of the pulverized coal was shown in Table 2 here-below.

TABLE 2

| C | H | O | N | Ash (wt. %) |
|---|---|---|---|---|
| 70-75 | 2-5 | 5-12 | 1-2 | 10-15 |

In Test No. 2 operation, flame temperature at the tuyere nose was reduced as much as possible, and furnace top gas was still increased. Through the furnace top iron ores of 1600 kg/ton., molten pig iron and cokes of 400kg/ton., molten pig iron were charged. Through the tuyeres, oxygen of 472 $Nm^2$/ton., molten pig iron, pulverized cokes of 500 kg/ton., molten pig iron and furnace top gas of 420 $Nm^3$/ton., molten pig iron for controlling the flame temperature at the tuyere noses were blown in. The fuel ratio was 900 kg/ton., molten pig iron which was a sum of coke ratio of 400 kg/ton., molten pig iron and pulverized coal ratio of 500 kg/ton., molten pig iron. The flame temperature at the nose of the tuyere was 2200° C. Preheating gas through the blown-in inlets at the intermediate shaft level was not introduced. Furnace top gas of 36210 kcal/ton., molten pig iron and 1532 $Nm^3$/ton., molten pig iron was generated from the furnace top. The cokes used in this Test No. 2 operation was same as those used in tEst No. 1.

Example 2

Test Nos. 3 through 5 of the present invention were operated, and the results of the operations are shown in Table 3 here-below.

TABLE 3

| Test Nos. of the Present invention | No. 3 | No. 4 | No. 5 |
|---|---|---|---|
| $DI_{15}^{30}$ (%) | 92.6 | 85.0 | 80.0 |
| Blend ratio (%) | 100 | 30 | 80 |
| Productivity | 2.70 | 2.70 | 2.70 |

TABLE 3-continued

| Test Nos. of the Present invention | No. 3 | No. 4 | No. 5 |
|---|---|---|---|
| ton., molten pig iron/ day/$m^3$ | | | |
| Coke ratio (kg/ton., molten pig iron) | 350 | 353 | 355 |
| Pulverized coal ratio (kg/ton., molten pig iron) | 300 | 300 | 300 |
| Blown-in oxygen ($Nm^3$/ton., molten pig iron) | 350 | 350 | 350 |
| Blown-in preheating gas ($Nm^3$/ton., molten pig iron) | 100 (1000° C.) | 100 (1000° C.) | 100 (1000° C.) |
| Si Content of molten pig iron (wt. %) | 0.20 | 0.21 | 0.24 |
| Temperature of molten pig iron (°C.) | 1500 | 1501 | 1500 |
| Slipping (times/day) | 0.5 | 0.8 | 1.0 |
| Dust (kg/ton., molten pig iron) | 10 | 10.5 | 12 |

In Test No. 3, the coke ratio was 350 kg/ton., molten pig iron, the pulverized coal ratio 300 kg/ton., molten pig iron, and the fuel ratio 650 kg/ton., molten pig iron summing up the coke ratio and the pulverized coal ratio. The cokes used in this Test No. 3 were of $DI^{30}{}_{15}$ of 92.6%. The operation was stable and with slipping occurrence in a few times and dust generation in small amount.

In Test No. 4, the coke ratio was 353 kg/ton., molten pig iron, the pulverized coal ratio 300 kg/ton., molten pig iron and the fuel ratio 653 kg/ton., molten pig iron summing up the coke ratio and the pulverized coal ratio. The cokes used were composed of 30wt.% of those of 85.0% $DI^{30}{}_{15}$ and the rest of those of 92.6% DI 30/15. The cokes with 85.0% $DI^{30}{}_{15}$ was made from the coal having the following constituent by wt. %. The operation was stable and with slipping occurrence in a few times and dust generation in small amount.

TABLE 4

| Test Nos. of the present invention | No. 4 | No. 5 |
|---|---|---|
| $DI_{15}{}^{30}$ (%) | 85.0 | 80.0 |
| Medium volatile matters of U.S. coal (wt. %) | 20.3 | 10.3 |
| High volatile matters of U.S. coal (wt. %) | 4.4 | 14.4 |
| Austrailian semi-caking coal (wt. %) | 52.2 | 52.2 |
| Non-caking and slightly caking coal (wt. %) | 18.1 | 18.1 |
| Reflectance | 0.867 | 0.800 |
| Volatile matters (wt. %) | 33.55 | 35.00 |

In Test No. 5, the coke ratio was 355 kg/ton., molten pig iron, the pulverized coal ratio 300 kg/ton., molten pig iron, and the fuel ratio 655 kg/ton., molten pig iron summing up the coke ratio and the pulverized coal ratio. The use cokes consisted of 80wt.% of those of 80.0% $DI^{30}{}_{15}$ and the rest of those of 92.6. Even the use of 80wt.% of those of $DI^{30}{}_{15}$ of 80.0% had almost no affect on the productivity of the operation. The operation was stable with a slight increase in slipping occurrence and dust generation.

Example 3

On the condition of the fuel ratio being 550 kg/ton., molten pig iron and of the flame temperature at the tuyere noses being 2600° C., Test No. 6 wherein oxygen heated upto 400° C. was blown in through the tuyeres and Test No. 7 wherein oxygen of 25° C. was blown in were carried out according to the method of the present invention. The results are shown in Table 5. In Test No. 6 economical pulverized coal could be used in larger quantity, instead of expensive cokes.

TABLE 5

| Test Nos. of the present invention | No. 6 | No. 7 |
|---|---|---|
| Productivity ton., molten pig iron/day/$m^3$ | 3.0 | 3.0 |
| Coke ratio (kg/ton., molten pig iron) | 200 | 240 |
| Pulverized coal ratio (kg/ton., molten pig iron) | 350 | 310 |
| Blown-in oxygen ($Nm^3$/ton., molten pig iron) | 272 | 280 |
| Oxygen temperature (°C.) | 400 | 25 |
| Blown-in Preheating Gas ($Nm^3$/ton., pig iron) | 280 (1000° C.) | 300 (1000° C.) |

What is claimed is:

1. A method for operating a blast furnace comprising charging iron ores and low strength cokes having a drum index of $DI^{30}{}_{15}$ of 80 to 90% through a furnace top;

blowing an oxygen-containing gas which contains at least 40 vol % of gaseous oxygen together with pulverized coal through tuyeres into the blast furnace;

controlling a fuel ratio within a range of 500 to 930 kg/ton molten iron and a ratio of the pulverized coal within a range specified by the formula:

$$100 \text{ to} \left\{ \frac{530 - 300}{930 - 500} (X - 500) + 300 \right\} \text{kg/ton,}$$

molten pig iron, wherein X represents the fuel ratio; and blowing a preheating gas through blow-in inlets set in a furnace shaft portion into the blast furnace to preheat the burden introduced into the blast furnace.

2. The method of claim 1, wherein said oxygen-containing gas is oxygen.

3. The method of claim 2, wherein said oxygen is heated to 130° to 700° C.

4. The method of claim 1, wherein said oxygen-containing gas is heated to 130° to 700° C.

5. The method of claim 1, wherein said low strength cokes includes cokes having a drum index of $DI^{30}{}_{15}$ of 80–855.

6. A method of operating a blast furnace comprising charging iron ores and high strength cokes having a drum index of $DI^{30}{}_{15}$ of 92 or more and low strength cokes having a drum index of $DI^{30}{}_{15}$ of 80 to 90% through a furnace top;

blowing an oxygen-containing gas which contains at least 40 vol % of gaseous oxygen together with pulverized coal through tuyeres into the blast furnace;

controlling a fuel ratio within a range of 500 to 930 kg/ton, molten iron and a ratio of the pulverized coal within a range specified by the formula:

$$100 \text{ to} \left\{ \frac{530 - 300}{930 - 500} (X - 500) + 300 \right\} \text{kg/ton,}$$

molten pig iron, wherein X represents the fuel ratio; and blowing a preheating gas through blow-in inlets set in a furnace shaft portion into the blast furnace to preheat the burden introduced into the blast furnace.

7. The method of claim 6, wherein said oxygen-containing gas is heated to 130° to 700° C.

8. The method of claim 6, wherein said low strength cokes includes cokes having a drum index of $DI^{30}{}_{15}$ of 80 to 855%.

* * * * *

UNITED STATES PATENT AND TRADEMARK OFFICE

CERTIFICATE OF CORRECTION

PATENT NO. : 4,844,737

DATED : July 4, 1989

INVENTOR(S) : OONO et al

It is certified that error appears in the above-identified patent and that said Letters Patent is hereby corrected as shown below:

Column 4, line 55, "(c01)" should read --(c-1)--.

Column 6, line 44, "472 $Nm^2$/ton" should read --472 $Nm^3$/ton--.

Column 6, line 57, "tEst" should read --Test--.

Column 8, claim 5, last line, "80-855" should read --80-85%--.

Column 8, claim 8, last line, "80 to 855%" should be --80 to 85%--.

Signed and Sealed this

Tenth Day of December, 1991

*Attest:*

HARRY F. MANBECK, JR.

*Attesting Officer*

*Commissioner of Patents and Trademarks*